US008063922B2

(12) United States Patent
Masuda et al.

(10) Patent No.: US 8,063,922 B2
(45) Date of Patent: Nov. 22, 2011

(54) LIQUID CRYSTAL DISPLAY DEVICE

(75) Inventors: Takeshi Masuda, Ikoma (JP); Atsuyuki Tanaka, Tenri (JP); Yukihiro Sumida, Yamatokoriyama (JP); Tokihiko Shinomiya, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 947 days.

(21) Appl. No.: 11/989,956

(22) PCT Filed: May 23, 2006

(86) PCT No.: PCT/JP2006/310250

§ 371 (c)(1),
(2), (4) Date: Feb. 4, 2008

(87) PCT Pub. No.: WO2007/032124

PCT Pub. Date: Mar. 22, 2007

(65) Prior Publication Data

US 2010/0156964 A1 Jun. 24, 2010

(30) Foreign Application Priority Data

Sep. 15, 2005 (JP) ..... 2005-268704

(51) Int. Cl.
*G09G 5/10* (2006.01)

(52) U.S. Cl. ..... 345/691; 345/88; 345/102

(58) Field of Classification Search ..... 345/87, 345/88, 102, 691
See application file for complete search history.

(56) References Cited

U.S. PATENT DOCUMENTS

| | | | | |
|---|---|---|---|---|
| 6,377,236 | B1 * | 4/2002 | Karamoto | 345/102 |
| 6,392,620 | B1 * | 5/2002 | Mizutani et al. | 345/88 |
| 7,777,714 | B2 * | 8/2010 | Feng et al. | 345/102 |
| 2002/0003522 | A1 | 1/2002 | Baba et al. | |
| 2005/0162584 | A1 * | 7/2005 | Yamamoto et al. | 349/68 |
| 2008/0180385 | A1 * | 7/2008 | Yoshida et al. | 345/102 |

FOREIGN PATENT DOCUMENTS

| | | |
|---|---|---|
| JP | 2002-40390 | 6/2002 |
| JP | 2004-163829 | 6/2004 |
| JP | 2005-208425 | 4/2005 |

* cited by examiner

*Primary Examiner* — Amare Mengistu
*Assistant Examiner* — Premal Patel
(74) *Attorney, Agent, or Firm* — Harness, Dickey & Pierce, P.L.C.

(57) ABSTRACT

A control circuit changes the ratio of an illumination period to a non-illumination period in a frame period of a backlight according to a gradation level in the one frame period of an image displayed on a liquid crystal panel in such a manner that the higher the gradation level, the backlight illumination control circuit increases the ratio of the illumination period to the non-illumination period in the frame period of the backlight, and the lower the gradation level, the backlight illumination control circuit decreases the ratio of the illumination period to the non-illumination period in the frame period of the backlight and thereby controls illumination intensity toward the liquid crystal panel. A time center of illumination intensity in each one frame period of the backlight is controlled in order that the time center exists in a constant temporal position from the beginning of each frame period.

13 Claims, 12 Drawing Sheets

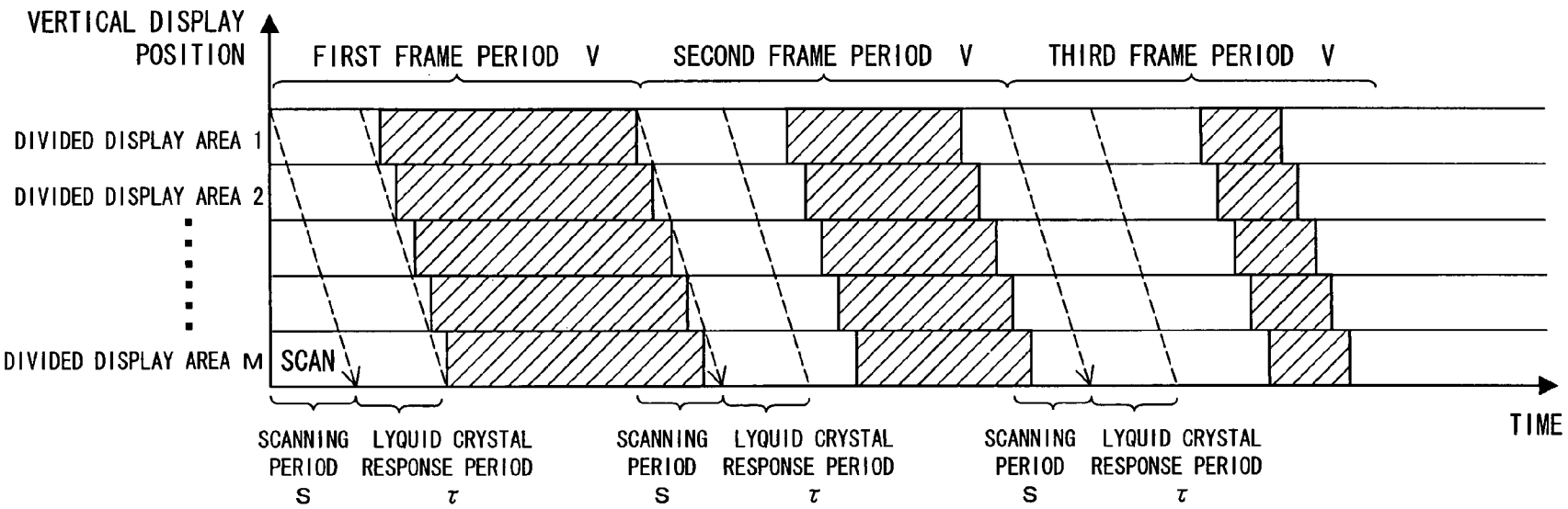
FIG. 5 (a)
VERTICAL DISPLAY POSITION
DIVIDED DISPLAY AREA 1
DIVIDED DISPLAY AREA 2
DIVIDED DISPLAY AREA M
FIRST FRAME PERIOD V
SECOND FRAME PERIOD V
THIRD FRAME PERIOD V
SCAN
SCANNING PERIOD s
LYQUID CRYSTAL RESPONSE PERIOD τ
TIME

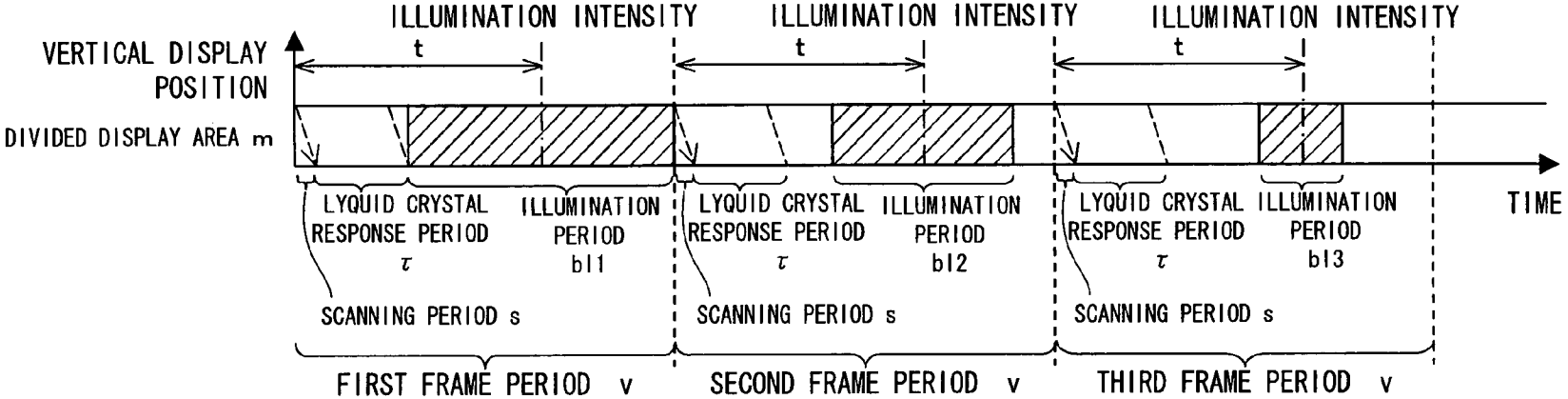
FIG. 5 (b)
VERTICAL DISPLAY POSITION
DIVIDED DISPLAY AREA m
TIME CENTER OF ILLUMINATION INTENSITY
t
LYQUID CRYSTAL RESPONSE PERIOD τ
ILLUMINATION PERIOD b11
ILLUMINATION PERIOD b12
ILLUMINATION PERIOD b13
SCANNING PERIOD s
FIRST FRAME PERIOD V
SECOND FRAME PERIOD V
THIRD FRAME PERIOD V
TIME FIG. 12 (a) PRIOR ART
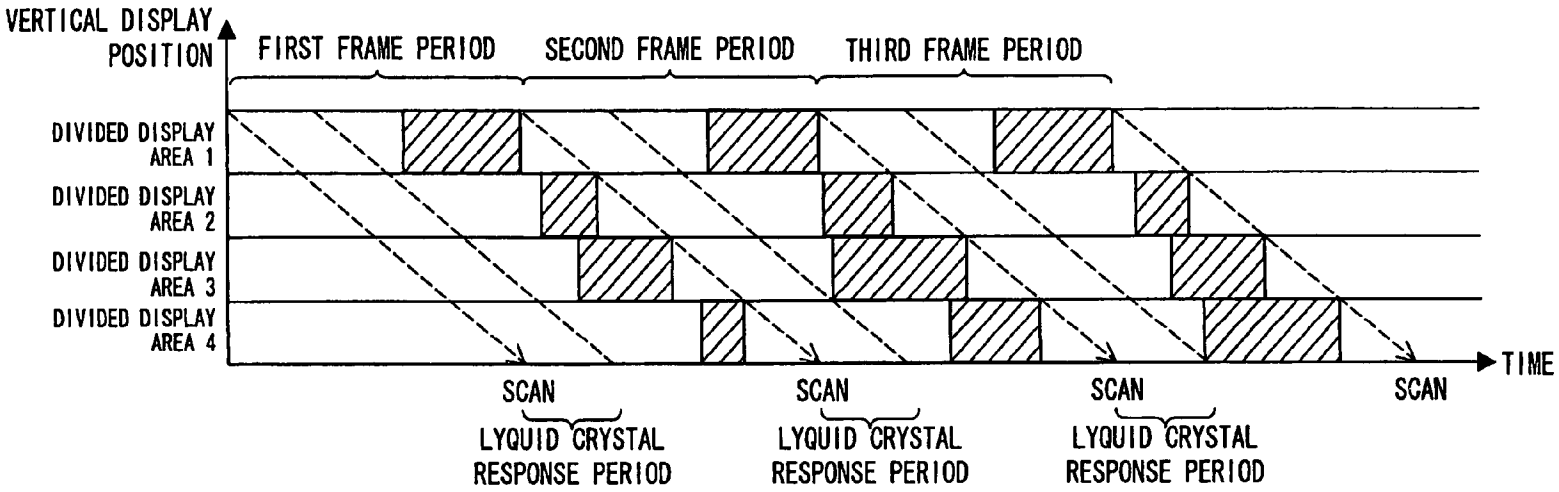
FIG. 12 (b) PRIOR ART
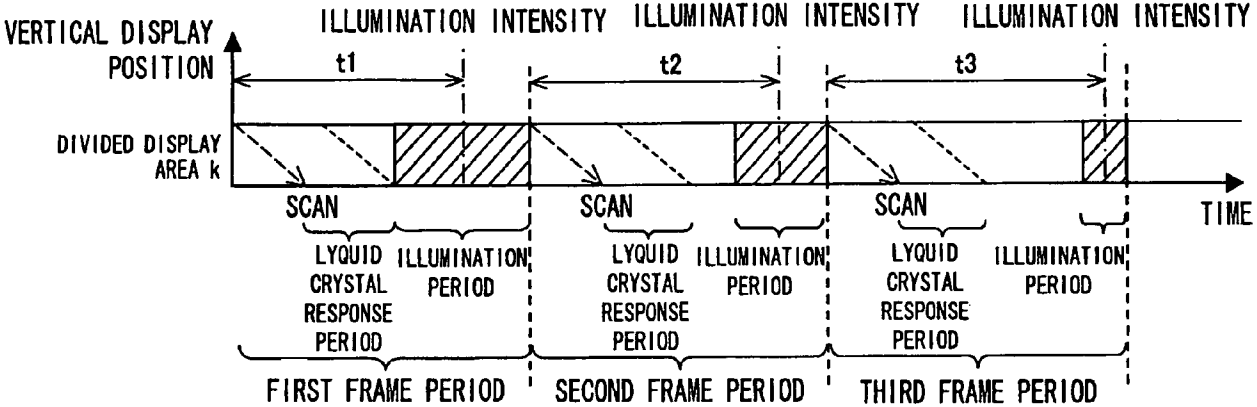

LIQUID CRYSTAL DISPLAY DEVICE

TECHNICAL FIELD

The present invention relates to a liquid crystal display device including a liquid crystal panel and a backlight, in particular, to a liquid crystal display device in which illumination light from the backlight is controlled to give a high contrast feeling and attain excellent performance of moving image display.

BACKGROUND ART

As for liquid crystal display devices, it is possible to realize thinness, low-power consumption, and high definition. Recently, liquid crystal display devices have been becoming larger rapidly due to progress of manufacturing technology and diffuse in the field of television in which cathode-ray tubes (CRT) are mainly used conventionally.

However, it has been pointed out that display images of liquid crystal display devices have problems in image quality such as a low contrast feeling and blurred moving images due to its display method, compared to images of CRT.

To begin with, the low contrast feeling of images of the liquid crystal display device is described, comparing with CRT with reference to FIG. 10 (*a*).

As for CRT, peak brightness changes dynamically according to average luminance level (APL) of image signals in one frame. For instance, contrast between bright parts and dark parts in a display screen is enhanced by displaying images of high APL (i.e., an entire display screen is bright) with low peak brightness or displaying images of low APL (i.e., an entire display screen is dark) with high peak brightness. Thus, a CRT can display sharp images giving a high contrast feeling.

In contrast, general liquid crystal display devices employs a display method in which the intensity of illumination light from a backlight is always constant and a liquid crystal panel controls the light transmittance of the illumination light. As a result, an image gives a low contrast feeling and lacks sharpness compared to an image of a CRT because a peak brightness does not change according to an average luminance level (APL) in the general liquid crystal display devices.

The causes why the performance of moving image display of the liquid crystal display devices is said to be inferior to that of CRT is described as to each of their display methods below with reference to FIG. 10 (*b*).

CRT adopts so-called an impulse type display method. In the impulse type display method, the image is displayed by scanning pixels with an electron beam in one frame thereby causing fluorescent material of the pixels to emit light. Thus, the pixels do not emit light except when they receive the electron beam. As a result, observer's eyeballs smoothly follow a moving object in a moving picture.

In contrast, the general liquid crystal display device adopts a hold type display method. In the hold type display method, an image is displayed by controlling transmittance of the illumination light from the light source by applying an electric field on liquid crystal in a liquid crystal panel. In each pixel, the transmittance is "held" by applying a voltage on the liquid crystal in one frame period. Thus, the moving picture, which changes time to time, is displayed as one still image in each frame period. As a result, there is a difference between the moving picture to be displayed and the still image that is actually displayed. A viewer perceives this difference as blurring.

In order to solve the problems of liquid crystal display devices above, Japanese Unexamined Patent Publication No. 40390/2002 (Tokukai 2002-40390 (published on Feb. 6, 2002)) discloses a liquid crystal display device which improves a contrast feeling by changing the ratio of an illumination period to a non-illumination period according to a display image in order to control the intensity of illumination light and has excellent performance in moving image display.

FIG. 11 is a block diagram of a liquid crystal display device disclosed in the publication above.

As illustrated in the figure, a liquid crystal display device 100 includes a liquid crystal panel 101 and a backlight 110 including a light source 111, a lightguide 112, and a liquid-crystal shutter 113.

The liquid crystal panel 101 is, what is called, an active-matrix liquid crystal panel. Pixels are arrayed in a matrix pattern corresponding to intersecting points of a plurality of scanning lines with a plurality of signal lines. Switching elements are provided corresponding to the pixels. An input image signal is supplied from a signal line to each pixel on one row selected by a scanning line. This is repeated by performing sequential scanning so as to apply the electric field to the liquid crystal of each pixel thereby controlling the light transmittance of the illumination light from the backlight. In this way, the display images are displayed.

The liquid crystal shutter 113 is divided into four parts in a stripe pattern in the direction of scanning lines of the liquid crystal panel 101 (in a horizontal direction). The electric field is applied on the liquid crystal in the liquid crystal shutter 113 in order to control transmittance and absorption of light thereof. Thus, the backlight 110 has four divided illumination areas in a stripe pattern and controls turning on/off of illumination in the divided illumination areas independently.

A peak luminance level detector circuit 121 is a circuit for measuring a peak luminance level of a display image signal. The peak luminance level detector circuit 121 measures a peak luminance level of an image displayed in a frame period in each divided area of the liquid crystal display device 100 corresponding to each of the divided illumination areas of the backlight 110.

The peak luminance level detector circuit 121 is connected to a backlight illumination control circuit 122. According to the measured peak luminance level, the backlight illumination control circuit 122 controls illumination ratio (illumination lump), that is, the intensity of illumination light in one frame period each divided illumination area of the backlight 110 independently.

A gradation converter circuit 123 converts a gradation of a display image signal on the basis of relation between the display image signal and the intensity of illumination light of each divided illumination area of the backlight 110, thereby generating an input image signal to be inputted to the liquid crystal panel 101.

FIG. 12 (*a*) and FIG. 12 (*b*) illustrate timing of when to input an input image signal to the liquid crystal panel 101 and the timing of when to turn on/off the backlight 110 in the liquid crystal display device 100. In FIG. 12 (*a*) and FIG. 12 (*b*), the horizontal axis indicates time; the vertical axis indicates vertical display positions of the liquid crystal display device.

As illustrated in FIG. 12 (*a*), in every one frame, the liquid crystal display device 100 controls the intensity of illumination light by changing the ratio of an illumination period to a non-illumination period of each of the divided illumination areas of the backlight 110 according to the peak luminance level of an image displayed on each of the divided areas of the liquid crystal display device 100. In other words, an illumination period of the backlight 110 is long and thereby the intensity of illumination light of the backlight is high in that divided area of the liquid crystal display device 100 whose display image is bright. On the other hand, in a divided area whose display image is dark, an illumination period of the backlight 110 is short and thereby the intensity of illumination light of the backlight 110 is low. Thus, it is possible to display sharp images giving a high contrast feeling due to enhanced contrast between the bright parts and the dark parts in a display screen.

In a case of moving image display, there are an illumination period and a non-illumination period of the backlight 110 according to the peak luminance levels in one frame period when brightness of a display image in each of the divided areas changes every frame period. With this, the liquid crystal display device of, so-called, the hold type display method can act like a liquid crystal display device of the impulse type display method, and thus attain better performance of moving image display.

However, the conventional liquid crystal display device 100 has problems described below.

As illustrated in FIG. 10 (*b*), with regard to the timing of when to and not to cause light emission of a specific pixel of the CRT of the impulse type display method, the specific pixel repeats illumination and non-illumination in a specific timing in one frame period. This timing does not change depending on a display image.

On the other hand, as for the conventional liquid crystal display device 100, the timing when to and not to display (i.e., the timing of when to and not to cause illumination of the backlight 110) in a specific divided area changes in one frame period according to a display image as illustrated in FIG. 12 (*b*). That is to say, a time center of a display image in a frame period, in other words, a time center of the intensity of illumination light fluctuates depending on a display image. This causes flickers perceivable to a viewer.

DISCLOSURE OF INVENTION

The present invention is accomplished in view of the aforementioned problem. An object of the present invention is to realize a liquid crystal display device of high picture quality, being free from perceived flickers, giving a high contrast feeling, and being excellent in the performance of moving image display.

In order to attain the object, a liquid crystal display device of the present invention includes a liquid crystal panel, a backlight for illuminating the liquid crystal panel, and a control means for controlling intensity of illumination light of the backlight, wherein: according to a gradation level in unit time of an image displayed on the liquid crystal panel, the control means controls the intensity of the illumination light toward the liquid crystal panel by changing a ratio of an illumination period to a non-illumination period of the backlight in the unit time in such a manner that the higher the gradation level, the control means increases the ratio of the illumination period to the non-illumination period of the backlight in the unit time, and the lower the gradation level, the control means decreases the ratio of the illumination period to the non-illumination period of the backlight in the unit time; and the control means controls the intensity of the illumination light in such a manner that in each unit time a time center of the intensity of illumination light of the backlight is constantly at a temporal position from the beginning of the unit time.

As for the present invention, a unit time may be one frame period or a plurality of frame periods. In case, for instance, where a peak gradation level continues for continuous unit times, the arrangement of the present invention becomes identical with that of Japanese Unexamined Patent Publication, Tokukai, No. 2002-40390 as a result because a maximum illumination period in each unit time continues. However, it should be noted that Japanese Unexamined Patent Publication, Tokukai, No. 2002-40390 does not have the technical concept of the present invention. Therefore, the art of the present invention is completely different from that of Japanese Unexamined Patent Publication, Tokukai, No. 2002-40390.

The invention above is arranged such that according to the gradation level in unit time of the image displayed on the liquid crystal panel, the control means controls the intensity of the illumination light toward the liquid crystal panel by changing the ratio of the illumination period to the non-illumination period of the backlight in the unit time in such a manner that the higher the gradation level, the control means increases the ratio of the illumination period to the non-illumination period of the backlight in the unit time, and the lower the gradation level, the control means decreases the ratio of the illumination period to the non-illumination period of the backlight in the unit time.

Thus, in an area of the liquid crystal panel whose display image is bright: the illumination period of the backlight is long, so that light intensity of the backlight is high. On the other hand, in an area whose display image is dark: the illumination period is short, so that light intensity is low. Therefore, it is possible to display sharp images giving a high contrast feeling due to enhanced contrast between bright parts and dark parts in a display screen.

In a case of moving image display, there are an illumination period and a non-illumination period of the backlight according to a peak luminance level in unit time when brightness of a display image in each area changes every unit time. Thus, it is possible to modify a liquid crystal display device of, so-called, the hold type display method close to a liquid crystal display device of the impulse type display method, and thus, improve the performance of moving image display.

The invention above is arranged such that the control means controls the intensity of the illumination light in such a manner that in each unit time the time center of the intensity of illumination light of the backlight is constantly at the temporal position from the beginning of the unit time.

Thus, it is possible to realize a liquid crystal display device giving a high contrast feeling, being excellent in the performance of moving image display, and being free from flickers perceivable by a viewer because the time center of the intensity of illumination light is constant in continuous unit times.

Additional objects, features, and strengths of the present invention will be made clear by the description below. Further, the advantages of the present invention will be evident from the following explanation in reference to the drawings.

BRIEF DESCRIPTION OF DRAWINGS

FIG. 1 illustrates a timing of an input image signal inputted in a liquid crystal panel of the liquid crystal display device and the timing of when to turn on/off a backlight.

FIG. 5 (*a*) is an explanatory diagram illustrating a timing of an input image signal inputted in a liquid crystal panel and the timing of when to turn on/off a backlight with regard to the entire liquid crystal panel of the liquid crystal display device.

FIG. 5 (*b*) is an explanatory diagram illustrating the timing of an input image signal inputted in the liquid crystal panel and the timing of when to turn on/off the backlight with regard to a divided area in 'm' row of the liquid crystal panel of the liquid crystal display device.

FIG. 7 (*b*) is an explanatory diagram of illustrating a timing of an input image signal inputted in the liquid crystal panel and the timing of when to turn on/off the backlight with regard to a divided area in 'm' row of the liquid crystal panel of the liquid crystal display device.

FIG. 9 (*b*) is an explanatory diagram illustrating a timing of an input image signal inputted in the liquid crystal panel and the timing of when to turn on/off the backlight with regard to a divided area in 'm' row of the liquid crystal panel of the liquid crystal display device.

FIG. 10 (*b*) is a graph illustrating display methods of the conventional liquid crystal display device and the CRT.

FIG. 12 (*a*) is an explanatory diagram of, with regard to entire liquid crystal panel of the conventional liquid crystal display device, the timing of input image signal inputted in the liquid crystal panel and the timing of when to turn on/off the backlight.

FIG. 12 (*b*) is an explanatory diagram of, with regard to a divided area in 'k' row of the liquid crystal panel of the conventional liquid crystal display device, the timing of an input image signal inputted in the liquid crystal panel and the timing of when to turn on/off the backlight.

EXPLANATIONS OF LETTERS OR NUMERALS

Figure 1:
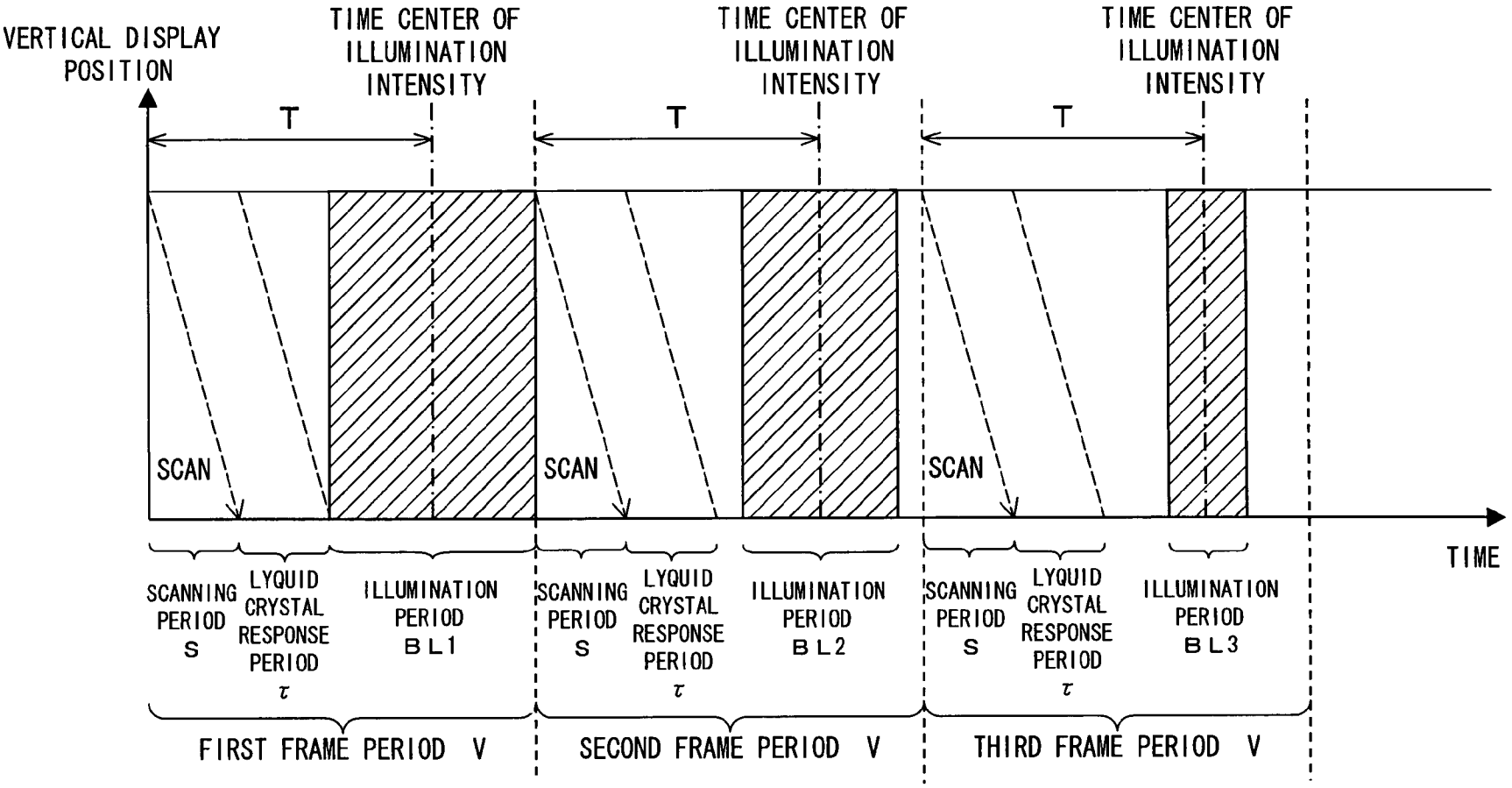
FIG. 1 is an explanatory diagram of an embodiment of a liquid crystal display device of the present invention.

1 Liquid crystal panel
2 Backlight
2*a* Light source
2*b* Lightguide
3 Frame frequency converter circuit (means for converting frame frequency)
4 Peak gradation level detector circuit
5 Backlight illumination control circuit (a control means)
6 Gradation converter circuit
10 Liquid crystal display device
20 Liquid crystal display device
21 Liquid crystal panel
22 Backlight
23 Frame frequency converter circuit (means for converting frame frequency)
24 Peak gradation level detector circuit
25 Backlight illumination control circuit
26 Gradation converter circuit
30 Liquid crystal display device
31 Liquid crystal panel
32 Backlight
34 Peak gradation level detector circuit
35 Backlight illumination control circuit (control means)
36 Gradation converter circuit
40 Liquid crystal display device
41 Liquid crystal panel
42 Backlight
44 Peak gradation level detector circuit
45 Backlight illumination control circuit (control means)
46 Gradation converter circuit

BEST MODE FOR CARRYING OUT THE INVENTION

Embodiment 1

An embodiment of the present invention is described below with reference to FIGS. 1 to 3.

Figure 2:
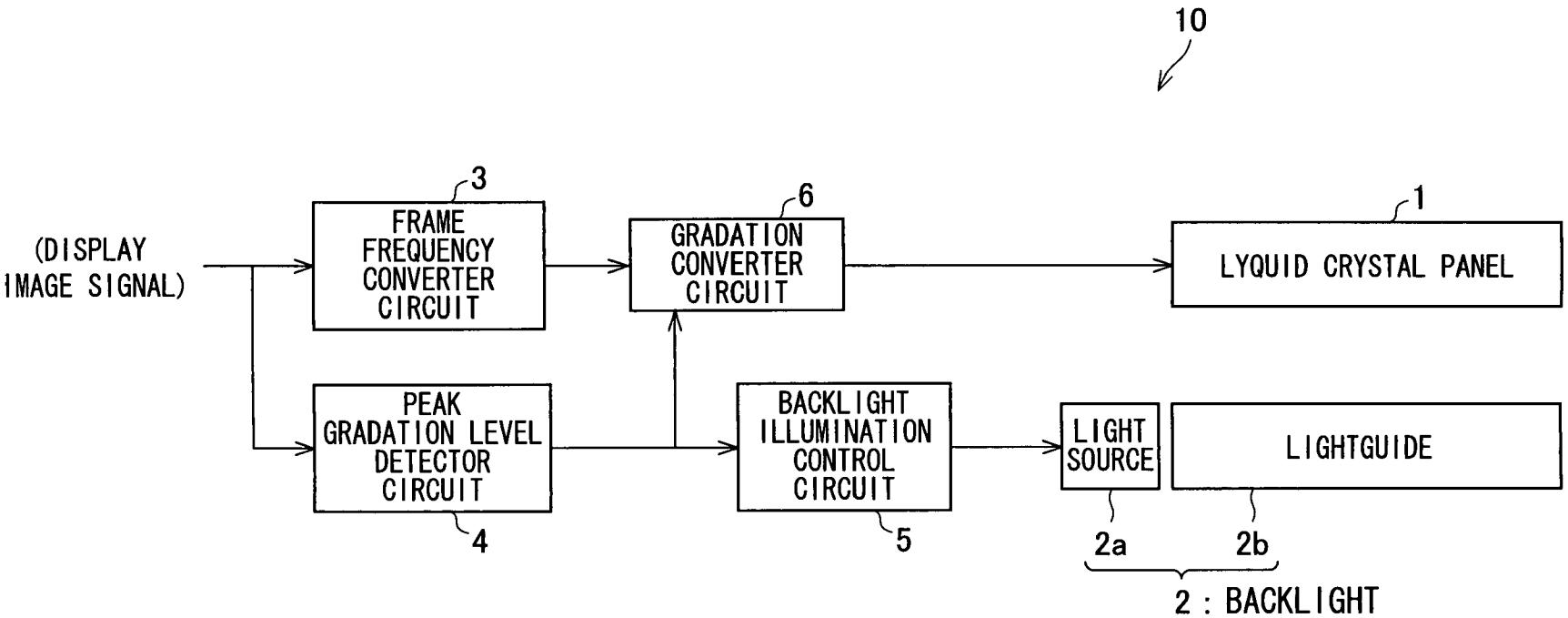
FIG. 2 is a block diagram of a structure of the liquid crystal display device.

FIG. 2 is a block diagram of main sections of a liquid crystal display device 10 of the present embodiment.

As illustrated in FIG. 2, the liquid crystal display device 10 includes a liquid crystal panel 1 and a backlight 2. The liquid crystal panel 1 displays an image by controlling, at each pixel, light transmittance of the illumination light from the backlight 2 in accordance with an inputted input image signal.

More specifically, the liquid crystal panel 1 is, what is called, an active-matrix liquid crystal panel. Pixels are arrayed in a matrix pattern corresponding to intersecting points of a plurality of scanning lines and a plurality of signal lines. Switching elements are provided corresponding to the pixels. An input image signal is supplied from the signal line to each pixel on a row selected by a scanning line. Display images are displayed under control of the light transmittance of the illumination light from the backlight 2 by sequential scanning in order to apply an electric field to liquid crystal of each pixel.

The backlight 2 includes a light source 2*a* including, for instance, a light emitting diode (LED) and a lightguide 2*b* for guiding the light from the light source 2*a* to the liquid crystal panel 1. The light source 2*a* is not limited to the light emitting diode (LED) used in the present embodiment as an example, and may be a fluorescent light (a cold-cathode tube).

In order to drive the liquid crystal display device 10, a frame frequency converter circuit 3 as a means for converting a frame frequency, a peak gradation level detector circuit 4, a backlight illumination control circuit 5 as a control means, and a gradation converter circuit 6 are provided in the present embodiment.

By the frame frequency converter circuit 3, a frame frequency of a display image signal to be displayed by the liquid crystal display device 10 is converted into a high frequency. Then, the frame frequency converter circuit 3 outputs the display image signal whose frequency was converted. The peak gradation level detector circuit 4 for measuring a peak gradation level of a display image signal to be displayed by the liquid crystal display device 10 is connected to a backlight illumination control circuit 5 and a gradation converter circuit 6.

The backlight illumination control circuit 5 changes the ratio of an illumination-on period (an illumination period) to an illumination-off period (a non-illumination period) of the light source 2*a* of the backlight 2 in one frame period according to that peak gradation level in one frame period, which is measured by the peak gradation level detector circuit 4. That is to say, the liquid crystal display device 10 is controlled such that the backlight 2 illuminates long in a frame period that a peak gradation level is high and thus a bright image is displayed, whereas the backlight 2 illuminates short in a frame period that a peak gradation level is low and thus a dark image is displayed.

The gradation converter circuit 6 converts the display image signal according to that peak gradation level in one frame period, which is measured by the peak gradation level detector circuit 4. In this way, the gradation converter circuit 6 generates an input image signal to be inputted to the liquid crystal panel 1.

Corresponding to the peak gradation level measured by the peak gradation level detector circuit 4, varied is relation between the ratio of the illumination period to the non-illumination period of the backlight 2 controlled by the backlight illumination control circuit 5 and the input image signal generated by the gradation converter circuit 6 to be inputted to the liquid crystal panel 1. The relation is set as described below in the present embodiment, for example.

$$BL=BL\max\times(W/W\max)^{\gamma} \quad \text{(Equation 1)}$$

$$w=(w_0/W)^{\gamma} \quad \text{(Equation 2)}$$

BLmax: A maximum illumination period in which the backlight can illuminate

BL: An illumination period controlled by the backlight illumination control circuit $w_0$: A gradation level of a display image signal for display on a pixel of the liquid crystal display device W: A peak gradation level measured by the peak gradation level detector circuit Wmax: An absolute peak gradation level at which the liquid crystal display device can display w: A gradation level of an input image signal of a pixel, the gradation level being generated by the gradation converter circuit γ: A gamma coefficient of the liquid crystal panel (A different value is employed according to the type of a liquid crystal panel)

A brightness I of a display image displayed by the liquid crystal display device 100 is eventually expressed by the product of (Equation 1) multiplied by (Equation 2).

$$I=(w_0/W)^{\gamma}\times BL\max\times(W/W\max)^{\gamma}=(w_0/W\max)^{\gamma}\times BL\max \quad \text{(Equation 3)}$$

To give a concrete example, when the absolute peak gradation level Wmax at which the liquid crystal display device 10 can display is gradation level of 255, the peak gradation level W measured by the peak gradation level detector circuit 4 is between the gray levels of 0 and 255 in accordance with the display image signal in one frame period. Then, the graduation level of the display image signal for display on a pixel of the liquid crystal display device 10 $W_0$ is at between 0 and W.

For instance, when the peak gradation level W measured by the peak gradation level detector circuit 4 is at the gradation level of 127 and the gradation level of the display image signal for display on the pixel of the liquid crystal display device 10 $w_0$ is at the gradation level of 63:

$$BL=BL\max\times(0.498)^{\gamma} \quad \text{(Equation 1')}$$

$$w=(0.496)^{\gamma} \quad \text{(Equation 2')}$$

$$I=(0.247)^{\gamma}\times BL\max \quad \text{(Equation 3')}$$

FIG. 1 illustrates a timing of an input image signal inputted in the liquid crystal panel 1 and the timing of when to turn on/off the light source 2*a* of the backlight 2. The horizontal axis indicates time; the vertical axis indicates vertical display positions.

An operation on a display image signal to be displayed by the liquid crystal display device 10 in one frame period V is described below.

The liquid crystal panel 1 is scanned with the input image signals in a scanning period S. The liquid crystal of each pixel in the liquid crystal panel 1 subsequently completes response in a liquid crystal response period τ.

Therefore, with a maximum illumination period BLmax of {V−(S+τ)}, the backlight illumination control circuit 5 determines an illumination period BL and a non-illumination period (V−BL) of the backlight 2 based on (Equation 1). Furthermore, the backlight illumination control circuit 5 controls when to turn on/off of the backlight 2 in order that a time center of an illumination period BL in a frame period V, that is, a time center of the intensity of illumination light may be at a temporal position after T time period elapsed from the beginning of the frame period V. In other words, the backlight illumination control circuit 5 turns the backlight 2 on at a temporal position after (T−BL/2) time period from the beginning of a frame period V and turns the backlight 2 off at (T+BL/2) time period from the beginning of a frame period V. The time period T which is the time center of the intensity of illumination light in the frame period V is expressed by the equation below.

$$\begin{aligned} T &= (S+\tau+BL\max/2) \quad \text{(Equation 4)} \\ &= (S+\tau+\{V-(S+\tau)\}/2) \\ &= (V+S+\tau)/2 \end{aligned}$$

Specifically, in a case where the frame frequency of a display image signal is 60 Hz and is converted into 240 Hz by the frame frequency converter circuit 3 and the liquid crystal response period τ of the liquid crystal panel 1 is 5 msec, then:

V=1/60 (sec)=16.67 (msec)

S=1/240 (sec)=4.17 (msec)

BLmax=7.50 (msec)

T=12.92 (msec)

The described liquid crystal display device 10 above displays sharp images giving a high contrast feeling and has the performance of moving image display close to that of the impulse type display method. In addition, the liquid crystal display device 10 has an advantage that flickers of images do not occur because the time center of the illumination light from the backlight 2 in the frame period V, that is, the time center of the image displayed by the liquid crystal display device 10 does not change.

Figure 3:
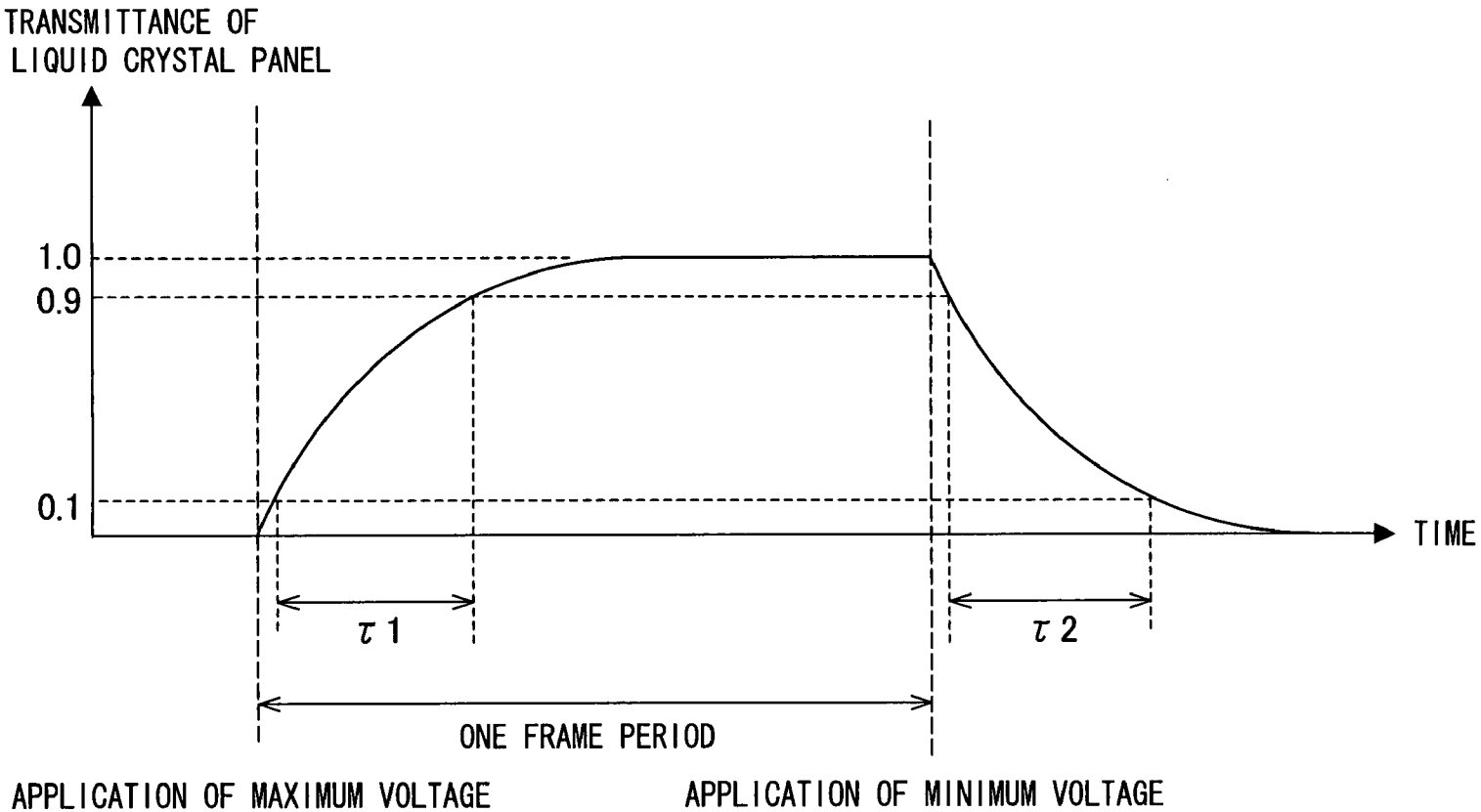
FIG. 3 is a waveform chart illustrating response periods of the liquid crystal display device.

As illustrated in FIG. 3, there are two types of the liquid crystal response period τ: liquid crystal response period τ1 concerning a rise when a maximum voltage is applied; and a liquid crystal response period τ2 concerning a fall when a minimum voltage is applied. In particular, the liquid crystal response period τ1 is a period that light transmittance changes from 0.1 to 0.9 while light transmittance of the liquid crystal panel 1 changes from 0 (minimum) to 1 (maximum) in a case where the voltage application to the liquid crystal is changed from a minimum voltage application for minimum light transmittance of the liquid crystal panel 1 to a maximum voltage application for maximum light transmittance of the liquid crystal panel 1. In contrast, the liquid crystal response period τ2 is a period that light transmittance changes from 0.9 to 0.1 while light transmittance of the liquid crystal panel 1 changes from 1 (maximum) to 0 (minimum) in a case where a minimum voltage is applied to liquid crystal in order that the voltage application to the liquid crystal is changed from the maximum voltage application for the maximum light transmittance of the liquid crystal panel 1 to the minimum voltage application for the minimum light transmittance of the liquid crystal panel 1. The liquid crystal response periods $\tau 1$ and $\tau 2$ are not equal ($\tau 1 \neq \tau 2$) generally and change depending on the temperature of liquid crystal.

Therefore, the liquid crystal response period $\tau$ above is referred to mean the liquid crystal response period $\tau 1$ in some cases, or to mean the liquid crystal response period $\tau 2$ in other cases.

In the present embodiment, the liquid crystal response period $\tau$ of the liquid crystal panel 1 is taken into consideration. However, the present invention is not limited to this: if the liquid crystal response period $\tau$ is set at 0 without consideration on the liquid crystal response period $\tau$, it is possible to lengthen the maximum illumination period BLmax of the backlight 2 by just that much, thereby improving the brightness of the liquid crystal display device 10.

Besides, the scanning period S is considered in the present embodiment. However, the present invention is not limited to this: if the scanning period S is set at 0 without consideration on the scanning period, it is possible to lengthen the maximum illumination period BLmax of the backlight 2 by just that much, thereby improving the brightness of the liquid crystal display device 10.

In the present embodiment, the illumination period and the non-illumination period of the light source 2*a* of the backlight 2 in the frame period V are determined according to the peak gradation level detected by the peak gradation level detector circuit 4 in the frame period V. However, the gradation level as the standard is not limited to the peak gradation level. An appropriate graduation level such as an average gradation level and the like may be the gradation level as the standard.

In the present embodiment, once the light source 2*a* of the backlight 2 is turned on, the illumination of the light source 2*a* of the backlight 2 continues until a turnoff thereof. However, the present invention is not limited to this, and may be arranged such that the light source 2*a* is turned on intermittently like pulses.

Embodiment 2

Another embodiment of the present invention is described below with reference to FIGS. 4 and 5. Note that the present embodiment is identical with Embodiment 1 except these points described below. For the sake of simplicity, members with same functions as those of members illustrated in the figures of Embodiment 1 are given the same symbols and descriptions for the members are omitted.

Figure 4:
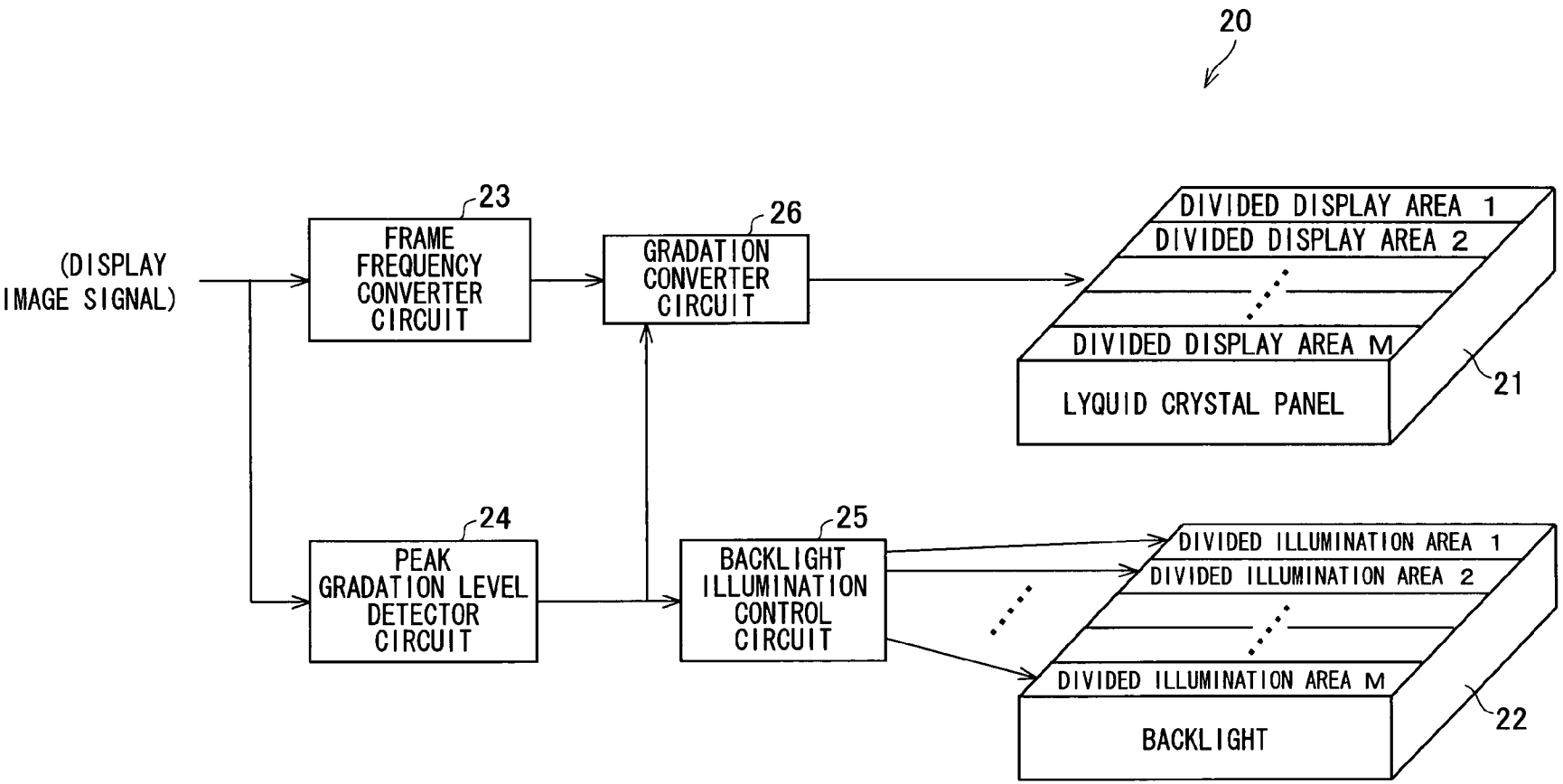
FIG. 4 is a block diagram of another embodiment of a liquid crystal display device of the present invention.

FIG. 4 is a block diagram of main sections of a liquid crystal display device 20 of the present embodiment.

What is significantly different of the liquid crystal display device 20 of the present embodiment from the liquid crystal display device 10 of Embodiment 1 is that a backlight 22 is divided into divided illumination areas in 'M' rows in a stripe pattern and each of the divided illumination areas turns on/off illumination independently.

In particular, the backlight 22 is a backlight of direct-under type on which a number of light emitting diodes (LED) not shown in figures are arrayed. The light emitting diodes (LED) illuminate by each of the divided illumination areas in which the light emitting diodes reside.

A liquid crystal panel 21 can be imaginarily divided into divided display areas corresponding to the divided illumination areas of the backlight 22. Also, the liquid crystal display device 20 can be imaginarily divided into divided areas corresponding to the divided illumination areas of the backlight 22.

A frame frequency converter circuit 23 as a means for converting frame frequency, a peak gradation level detector circuit 24, and a gradation converter circuit 26 are the same as the frame frequency converter circuit 3, the peak gradation level detector circuit 4, and the gradation converter circuit 6 in Embodiment 1.

A backlight illumination control circuit 25 as a control means changes a ratio of an illumination-on period (an illumination period) to an illumination-off period (a non-illumination period) of the backlight 22 in one frame period V according to a peak gradation level measured by the peak gradation level detector circuit 24 in one frame period V, and controls the ratio in each divided illumination area independently.

The relation of the ratio of an illumination period to a non-illumination period of the backlight 22 controlled by the backlight illumination control circuit 25 according to the peak gradation level measured by the peak gradation level detector circuit 24 and the input image signal generated at the gradation converter circuit 26 to the liquid crystal panel 21 is the same as in Embodiment 1.

FIG. 5 (*a*) and FIG. 5 (*b*) with regard to the liquid crystal display device 20 illustrate a timing of an input image signal inputted to the liquid crystal panel 21 and a timing of when to turn on/off backlight 2. In FIG. 5 (*a*) and FIG. 5 (*b*), the horizontal axis indicates time; the vertical axis indicates vertical display positions. FIG. 5 (*a*) is an explanatory diagram of the entire liquid crystal display device 20. FIG. 5 (*b*) is an explanatory diagram of a divided area in 'm' row of a liquid crystal display device 200.

An operation carried out in a frame period V on a display image signal to be displayed by the liquid crystal display device 20 is described below.

To begin with, the liquid crystal panel 21 is scanned with input image signals in a scanning period S and subsequently liquid crystal of each pixel in the liquid crystal panel 21 completes response in a liquid crystal response period $\tau$.

A divided illumination area of the backlight 22 becomes possible to illuminate after the completion of the scanning of the corresponding divided illumination area of the liquid crystal panel 21 with the input image signals and the liquid crystal response in the corresponding divided display area of the liquid crystal panel 21. Therefore, if as illustrated in FIG. 5 (*b*), a divided display area of the liquid crystal panel 21 is scanned with input display signals in a scanning period s (=S/M) in one frame period v (=V) and the liquid crystal subsequently completes a response in a liquid crystal response period $\tau$, this will give a maximum illumination period blmax of $\{v=(s+\tau)\}$.

The backlight illumination control circuit 25 determines an illumination period b1 and a non-illumination period (v−b1) in the frame period V based on (Equation 1). In addition, in one frame period of a divided display area of the liquid crystal panel 21, the backlight illumination control circuit 25 controls when to turn on/off of the illumination in order that a time center of the illumination period b1 of a corresponding divided illumination area of the backlight 22 may be at a temporal position after t time period from the beginning of the frame period. In other words, the backlight illumination control circuit 25 turns on the divided illumination area of the backlight 22 corresponding to the divided display area after (t−b1/2) time period from the beginning of the frame period V of the divided display area. Then, the backlight illumination control circuit 25 turns off the divided illumination area of the backlight 22 corresponding to the divided display area after (t+b1/2) time period from the beginning of the frame period V of the divided display area. The time period t of the time center of the illumination period BL in one frame period V is expressed by the Equation below.

$$t = (s + \tau + blmax/2) \quad \text{(Equation 6)}$$
$$= (s + \tau + \{v - (s + \tau)\}/2)$$
$$= (v + s + \tau)/2$$

Specifically, in a case where the frame frequency of the display image signal is 60 Hz which is converted into 240 Hz by the frame frequency converter circuit 23, the liquid crystal response period τ is 5 msec, and the number of rows of divided illumination areas of the backlight 22 is 5, then:

V=v=1/60 (sec)=16.67 (msec)
S=1/240 (sec)=4.17 (msec)
s=0.83 (msec)
blmax=10.84 (msec)
t=11.25 (msec)

As is clear from the above, in the present embodiment, it is possible to improve the brightness of the liquid crystal display device 20 because the maximum illumination period blmax of the backlight 22 can be lengthened longer than a maximum illumination period BLmax of the backlight 2 under control of when to turn on/off the illumination of each divided illumination area individually by the backlight illumination control circuit 25, where the backlight 22 divided into each divided illumination area by 'M' rows in a stripe pattern.

Thus, the liquid crystal display device 20 displays sharp images giving a high contrast feeling and has the performance of moving image display close to that of the impulse type display method. In addition, the liquid crystal display device 20 has an advantage that flickers of images do not occur because the time period t of a time center of an image displayed by the liquid crystal display device 20 in one frame period V does not change depending on an image.

Note that the frame frequency converter circuit 3 is not essential, and thus, may be omitted in the present embodiment. In this case, the scanning period S of the input image signal to the liquid crystal panel 21 is equal to the frame period V and the maximum illumination period blmax of the backlight 22 is short, that is, display images of the liquid crystal display device 20 are dark. Therefore, whether the frame frequency converter circuit 23 is included or not may be optionally chosen.

Embodiment 3

Still another embodiment of the present invention is described below with reference to FIGS. 6 and 7. Note that the present embodiment is identical with Embodiments 1 and 2 except these points described below. For the sake of simplicity, members with same functions as those of members illustrated in the figures of Embodiments 1 and 2 are given the same symbols and descriptions for the members are omitted.

Figure 6:
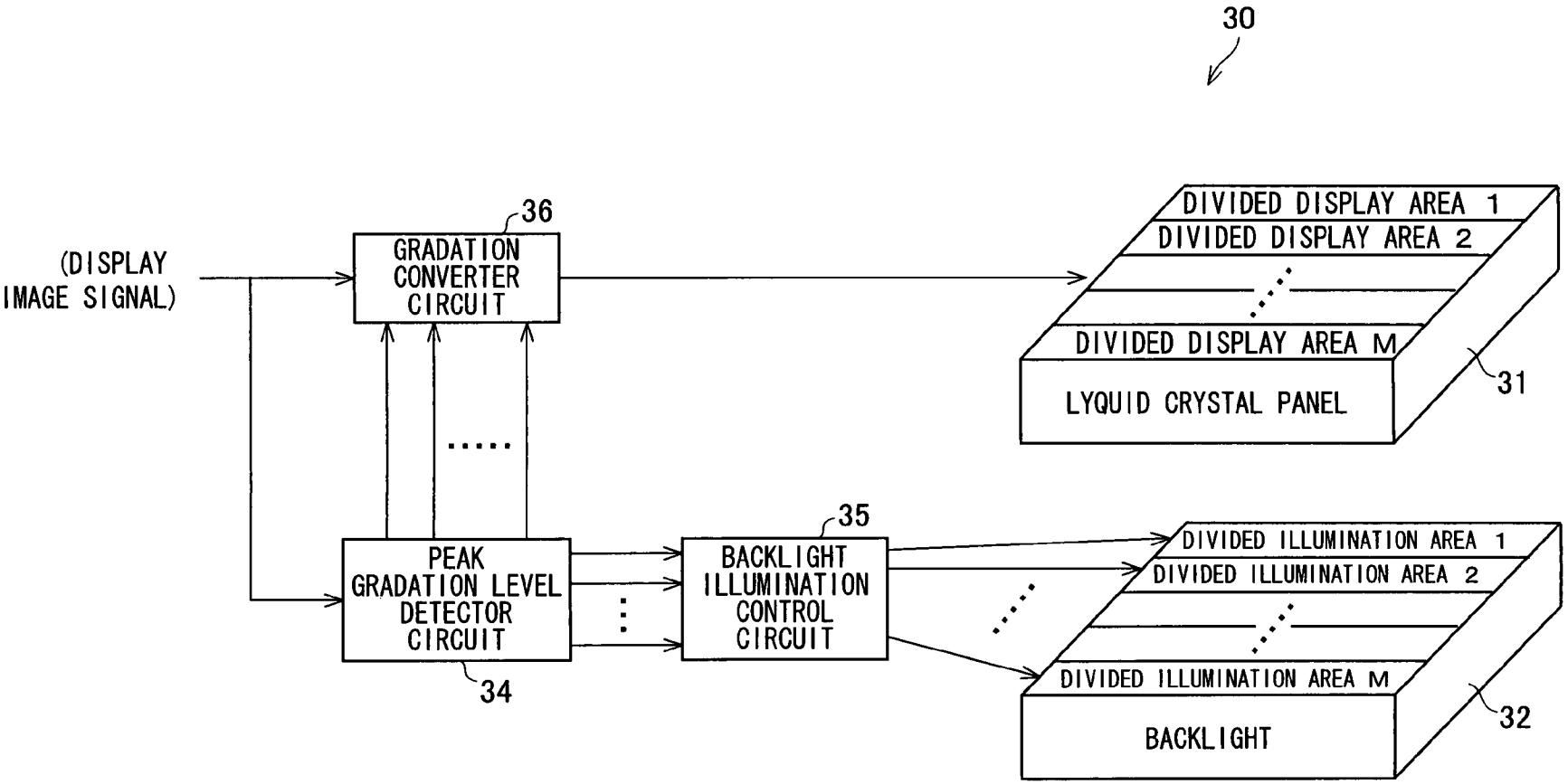
FIG. 6 is a block diagram of still another embodiment of a liquid crystal display device of the present invention.

The block diagram of main sections of a liquid crystal display device 30 of the present embodiment is shown in FIG. 6.

What is significantly different of the liquid crystal display device 30 of the present embodiment from the liquid crystal display device 20 of Embodiment 2 is that the peak gradation level detector circuit 34 measures a peak gradation level of a display image signal in every divided area of the liquid crystal display device 30 and outputs each peak gradation level to a backlight illumination control circuit 35 (a control means) and a gradation converter circuit 36, and that the frame frequency converter circuit 23 is omitted.

According to the peak gradation level measured by the peak gradation level detector circuit 34 in the frame period V in a divided area of the liquid crystal display device 30, the backlight illumination control circuit 35 controls the ratio of a light-on period to a light-off period in the frame period V in the corresponding divided illumination area of a backlight 32. Note that a liquid crystal panel 31 and a backlight 32 are the same as the liquid crystal panel 21 and the backlight 22 in Embodiment 2.

The gradation converter circuit 36 generates an input image signal to the liquid crystal panel 31 per display area by converting the display image signal according to that peak gradation level of one frame period V of the divided area of the liquid crystal display device 30, which is measured by the peak gradation level detector circuit 34.

The relation of a ratio of an illumination period to a non-illumination period controlled by the backlight illumination control circuit 35 according to the peak gradation level measured by the peak gradation level detector circuit and the input image signal to the liquid crystal panel 31 generated at the gradation converter circuit 36 is the same as in Embodiment 1.

Figure 7:
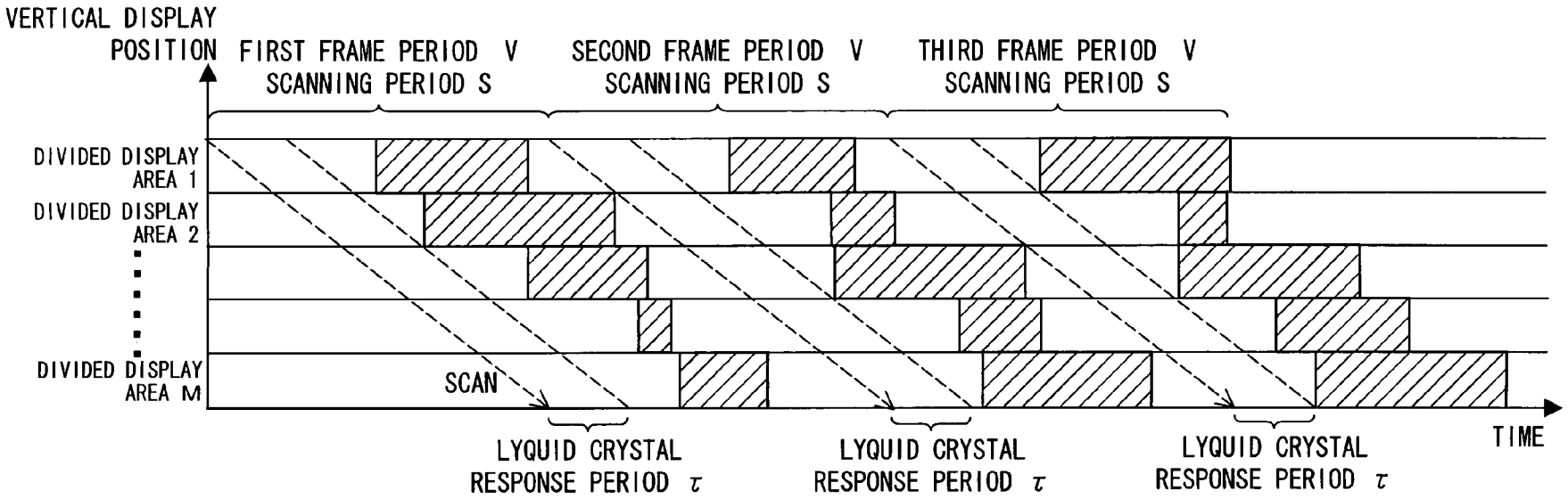
FIG. 7 (*a*) is an explanatory diagram illustrating a timing of an input image signal inputted in a liquid crystal panel and the timing of when to turn on/off a backlight with regard to the entire liquid crystal panel of the liquid crystal display device.
Figure 7:
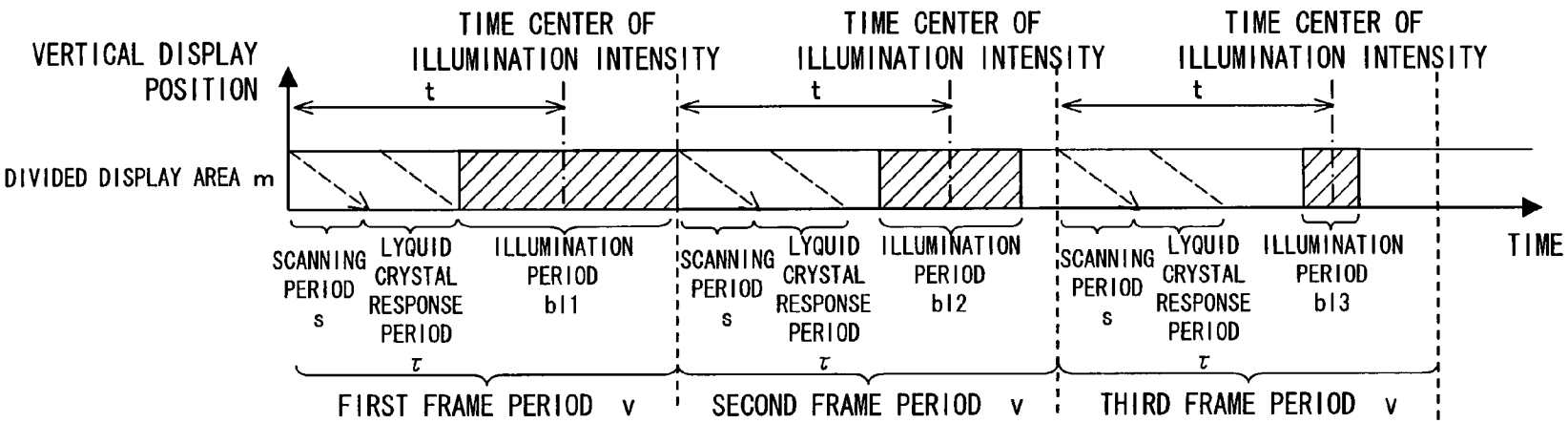

FIG. 7 (*a*) and FIG. 7 (*b*) illustrates a timing of the input image signal inputted to the liquid crystal panel 31 and the timing of when to turn on/off the backlight 32. In FIG. 7 (*a*) and FIG. 7 (*b*), the horizontal axis indicates time; the vertical axis indicates vertical display positions. FIG. 7 (*a*) is an explanatory diagram of the entire liquid crystal display device 30. FIG. 7 (*b*) is an explanatory diagram of a divided area in 'M' row of the liquid crystal display device 30.

An operation carried out in a frame period on a display image signal displayed by the liquid crystal display device 30 is the same as that of the liquid crystal display device 20 in Embodiment 2, except that the frame period V of the display image signal of the liquid crystal display device 30 and the scanning period S of the input signal to the liquid crystal panel 31 are equal because the frame frequency converter circuit 23 is omitted in the present embodiment.

Specifically, in a case wherein the frame frequency of the display image signal is 60 Hz; a response period τ of the liquid crystal panel is 5 msec; and the number of rows of divided illumination areas of the backlight 2 is 5, then:

V=1/60 (sec)=16.67 (msec)
S=1/60 (sec)=16.67 (msec)
s=3.33 (msec)
blmax=8.34 (msec)
t=12.50 (msec)

As described above, the liquid crystal display device 30 can display sharp images giving a higher contrast feeling than the liquid crystal display device 20 in Embodiment 2 because, for each image displayed in a divided area, the peak gradation level detector circuit 34 measures the peak gradation level of the display image signal, controls the ratio of the illumination period to the non-illumination period of the corresponding divided illumination area of the backlight 32, and optimizes, for the divided display area, an input image signal to be inputted into the liquid crystal panel 31.

In the present embodiment, a frame frequency converter circuit is not provided. However, the present invention is not limited to this, and the frame frequency converter circuit may be provided as in Embodiments 1 and 2. This arrangement makes it possible that a maximum illumination period blmax of the backlight 32 becomes longer, that is, display images of the liquid crystal display device 30 become brighter.

Embodiment 4

Still further another embodiment of the present invention is described below with reference to FIGS. 8 and 9. Note that the present embodiment is identical with Embodiments 1 to 3 except these points described below. For the sake of simplicity, members with same functions as those of members illustrated in the figures of Embodiments 1 through 3 are given the same symbols and descriptions for the members are omitted.

Figure 8:
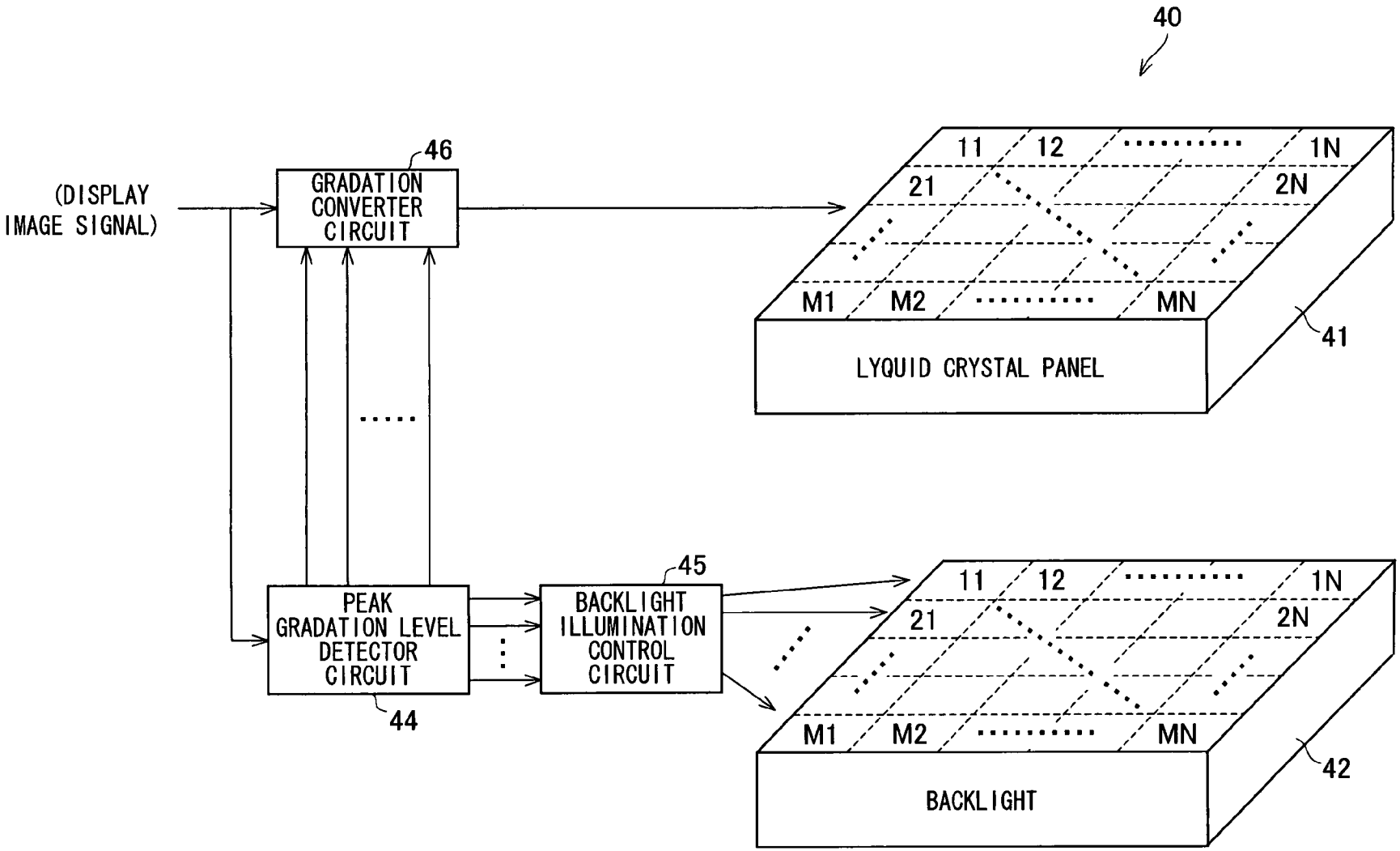
FIG. 8 is a block diagram of yet another embodiment of a liquid crystal display device of the present invention.

FIG. 8 is a block diagram of main sections of a liquid crystal display device 40 of the present embodiment.

What is significantly different of the liquid crystal display device 40 of the present embodiment from the liquid crystal display device 30 of Embodiment 3 is that a backlight 42 is divided into divided illumination areas in a matrix pattern of M rows and N columns and turning on/off the illumination is carried out in each divided illumination area individually.

In particular, the backlight 42 is a backlight of direct-under type on which a number of light emitting diodes (LED) are arrayed. Illumination is turned on/off by light emitting diodes (LED) in each divided illumination area individually.

A liquid crystal panel 41 can be imaginarily divided into divided display areas corresponding to the divided illumination areas of the backlight 42.

Also, the liquid crystal display device 40 can be imaginarily divided into the divided areas corresponding to the divided illumination areas of the backlight 42.

According to a peak gradation level of a divided area of the liquid crystal display device 40 measured by the peak gradation level detector circuit 44 in a frame period, a backlight illumination control circuit 45 as a control means changes the ratio of an illumination period to a non-illumination period in the corresponding divided illumination area of the backlight 42 in one frame period V.

A gradation converter circuit 46 generates an input image signal to the liquid crystal panel 41 for each divided display area individually by converting a display image signal according to that peak gradation level of the divided area of the liquid crystal display device 40 measured by the peak gradation level detector circuit 44 in one frame period V.

The relation of a ratio of an illumination period to a non-illumination period controlled by the backlight illumination control circuit 45 according to a peak gradation level measured by the peak gradation level detector circuit 44 and an input image signal to the liquid crystal panel 41 generated at the gradation converter circuit 46 is the same as Embodiment 1.

Figure 9:
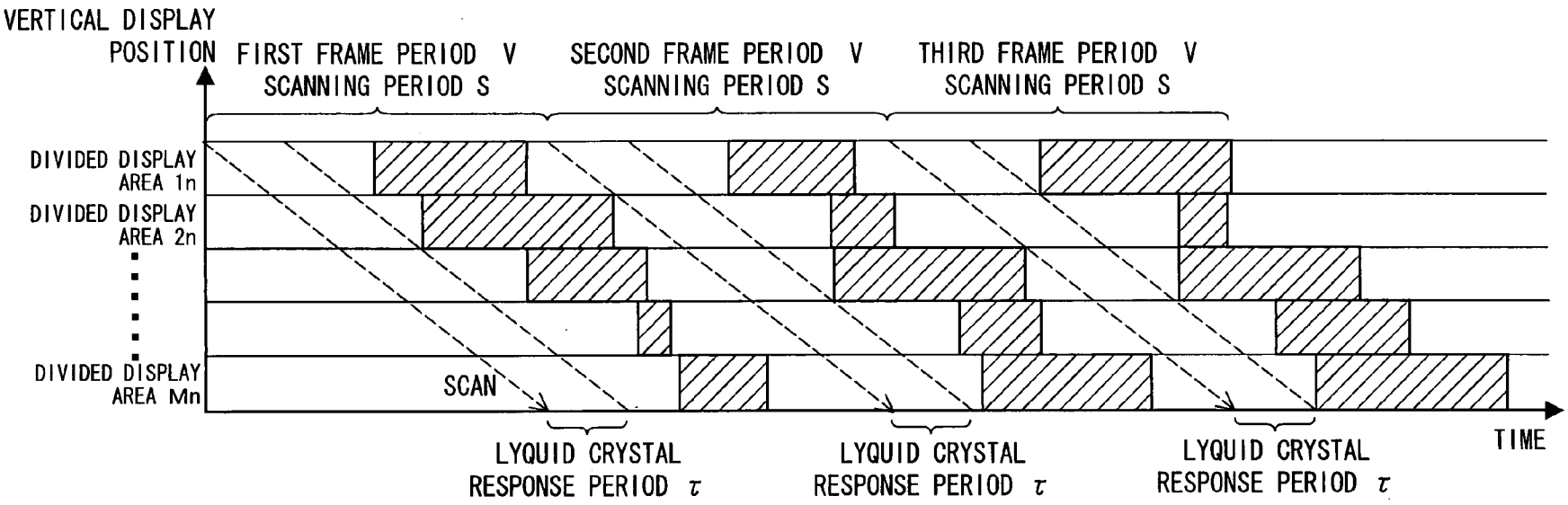
FIG. 9 (*a*) is an explanatory diagram illustrating a timing of input image signal inputted in a liquid crystal panel and the timing of when to turn on/off the backlight with regard to the entire liquid crystal panel of the liquid crystal display device.
Figure 9:
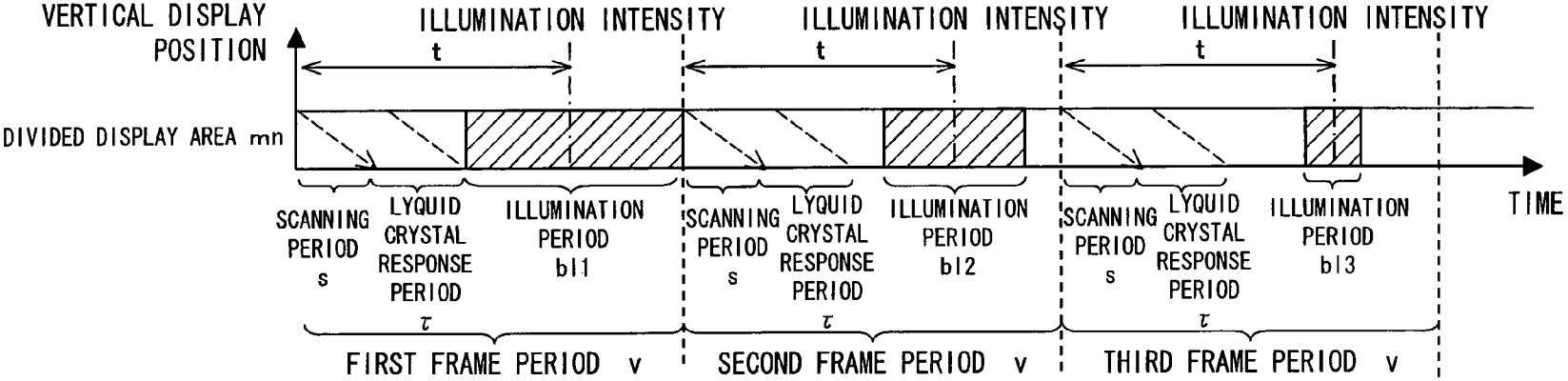
Figure 10:
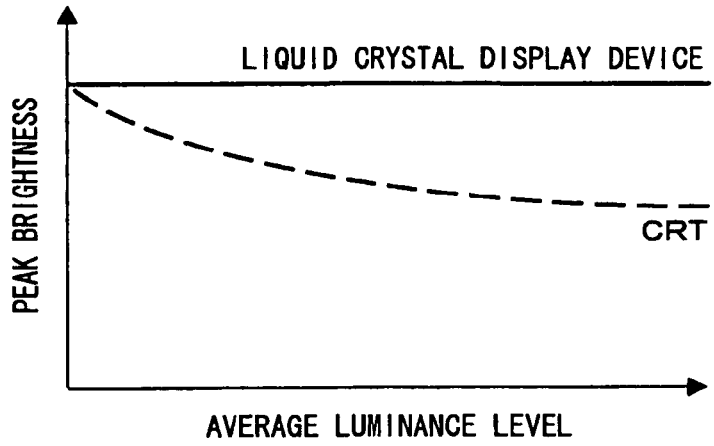
FIG.10 (a) CONVENTIONAL ART
FIG. 10 (*a*) is a view illustrating a conventional example and a graph illustrating the relation of peak brightness of a liquid crystal display device and that of a CRT.
Figure 10:
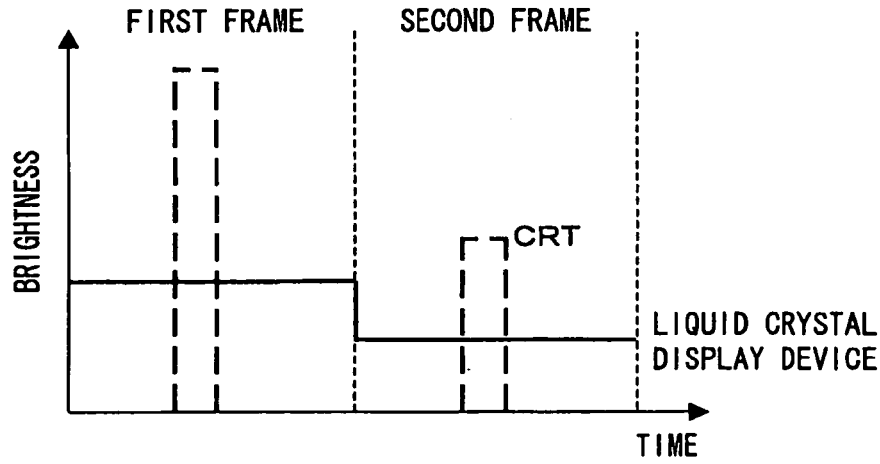
FIG.10 (b) CONVENTIONAL ART
Figure 11:
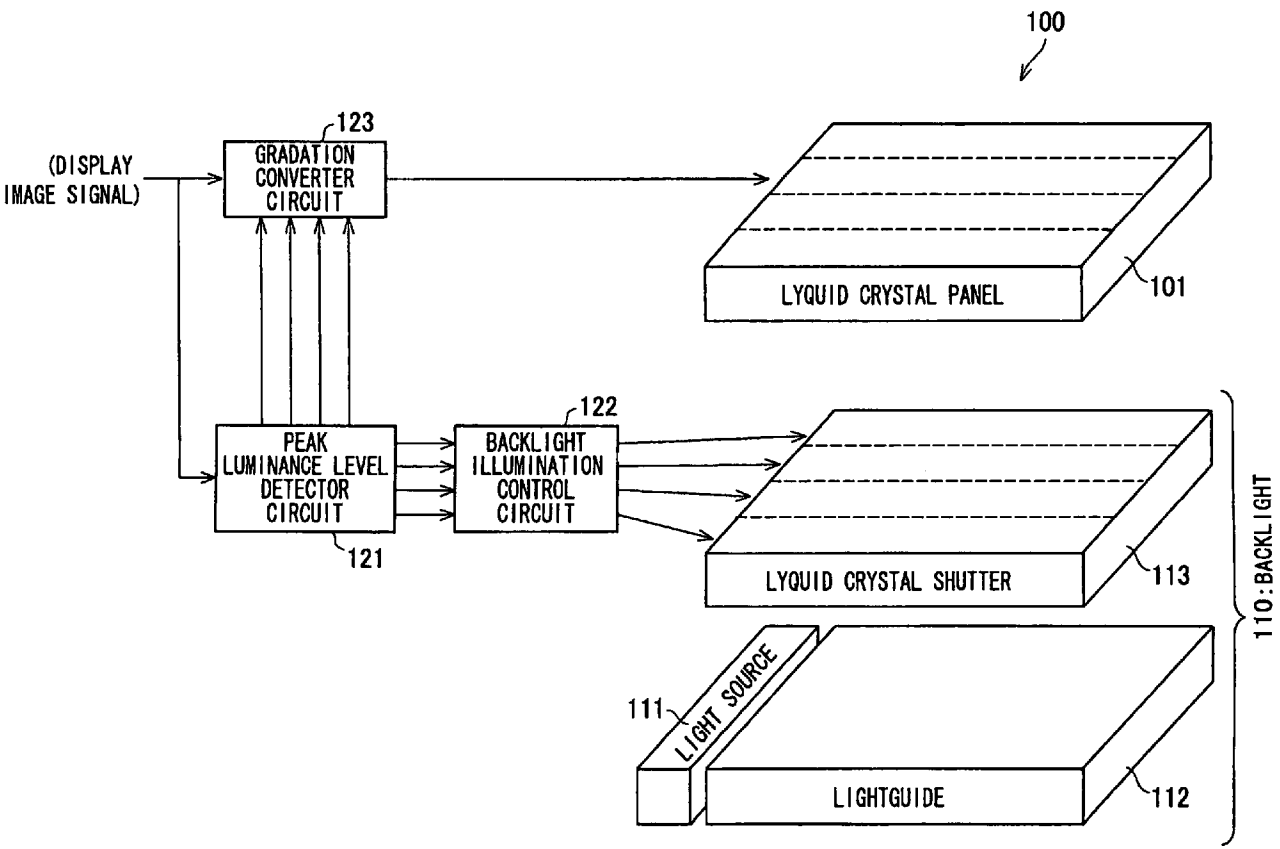
FIG. 11 PRIOR ART
FIG. 11 is a block diagram illustrating a structure of the conventional liquid crystal display device.

FIG. 9 (*a*) illustrates a timing of an input image signal inputted to the divided display area in 'n-th' column of the liquid crystal panel 41 corresponding to 'n-th' column of a divided area of the liquid crystal display device 40 and the timing of when to turn on/off the light of a divided illumination area in 'n-th' column of backlight 42. In FIG. 9 (*a*), the horizontal axis indicates time; the vertical axis indicates vertical display positions. FIG. 9 (*b*) is an explanatory diagram of a divided area in 'm-th' row and 'n-th' column of the liquid crystal display device 40.

An operation carried out in one frame period V of the display image signal displayed in the 'n-th' column of the divided areas of the liquid crystal display device 40 is the same as that of the liquid crystal display device 30 in Embodiment 3.

As described above, the liquid crystal display device 40 whose each divided area is further divided in a matrix pattern of 'M' rows and 'N' columns of the present invention can display finer images giving a higher contrast feeling than the liquid crystal display device 30 in Embodiment 3 because, in each image displayed in the divided area, the liquid crystal display device 40 controls the ratio of an illumination period to a non-illumination period of the corresponding divided illumination area of the backlight 42 according to that peak gradation level of the display image signal, which is measured by the peak gradation level detector circuit 44, and the liquid crystal display device 40 controls optimizes an input image signal to the liquid crystal panel 41 for every divided display area.

Note that, although a frame frequency converter circuit is not provided in the present embodiment, the present invention is not limited to this: the frame frequency converter circuit may be provided as in Embodiments 1 and 2. With this arrangement, a maximum illumination period blmax of the backlight 42 becomes longer, that is, display images of the liquid crystal display device 40 become brighter.

The liquid crystal display device according to the present invention is preferably arranged such that according to a gradation level in one frame period of the image displayed on the liquid crystal panel, the control means controls the intensity of the illumination light toward the liquid crystal panel by changing the ratio of the illumination period to the non-illumination period in one frame period in such a manner that the higher the gradation level, the control means increases the ratio of the illumination period to the non-illumination period in the one frame period, and the lower the gradation level, the control means decreases the ratio of the illumination period to the non-illumination period in the one frame period; and the control means controls the intensity of the illumination light in such a manner that in each frame period a time center of the intensity of illumination light of the backlight is constantly at a temporal position from the beginning of the frame period.

According to the invention, the unit time is one frame period. Accordingly, it is possible to realize a liquid crystal display device of high picture quality giving a high contrast feeling, being excellent in the performance of moving image display, and being free from flickers perceivable by a viewer because the time center of the intensity of illumination light in continuous frame periods.

The liquid crystal display device according to the present invention is preferably arranged such that $T=(V+S+\tau)/2$ where V is one frame period, S is a scanning period of a scan of one frame, $\tau$ is a response period of the liquid crystal panel, and T is a time from the beginning of the scan of one frame to the time center of the intensity of the illumination light in each frame period of the backlight.

Thus, a concrete time until a time center of the intensity of illumination light in each frame period T is calculated.

The liquid crystal display device according to the present invention is preferably arranged such that the backlight has a plurality of divided illumination areas; according to the gradation level in the unit time of an image displayed on the liquid crystal panel, the control means controls the intensity of the illumination light toward the liquid crystal panel by changing the ratio of the illumination period to the non-illumination period of the backlight in the unit time in such a manner that the higher the gradation level, the control means increases the ratio of the illumination period to the non-illumination period of the backlight in the unit time, and the lower the gradation level, the control means decreases the ratio of the illumination period to the non-illumination period of the backlight in the unit time; and the control means controls the intensity of the illumination light in such a manner that in each unit time each time center of the intensity of illumination light in the divided illumination areas of the backlight is individually and constantly at a temporal position from the beginning of the unit time.

In this invention, like the invention described above, the control means controls the intensity of illumination light toward the liquid crystal panel according to the gradation level in the unit time of the image displayed on the liquid crystal panel.

Meanwhile, the backlight of the present invention has a plurality of divided illumination areas. Accordingly, it is possible to improve brightness of an entire liquid crystal panel because it is possible to lengthen an illumination period in the unit time by every divided illumination area individually.

Further, the control means controls the intensity of the illumination light in such a manner that in each unit time each time center of the intensity of illumination light in the divided illumination areas of the backlight is individually and constantly at the temporal position from the beginning of the unit time.

Thus, the time center of the intensity of illumination light is constant in continuous unit times in a divided illumination area.

As a result, it is possible to realize a liquid crystal display device of high picture quality, whose entire liquid crystal panel is bright, being free from flickers perceivable by a viewer, giving a high contrast feeling, and being excellent in the performance of moving image display.

The liquid crystal display device according to the present invention is preferably arranged such that the backlight has a plurality of divided illumination areas; according to a gradation level in one frame period of the image displayed on the liquid crystal panel, the control means controls the intensity of the illumination light toward the liquid crystal panel by changing the ratio of the illumination period to the non-illumination period in one frame period in such a manner that the higher the gradation level, the control means increases the ratio of the illumination period to the non-illumination period in the one frame period, and the lower the gradation level, the control means decreases the ratio of the illumination period to the non-illumination period in the one frame period; and the control means controls the intensity of the illumination light in such a manner that in each frame period each time center of the intensity of illumination light in the divided illumination areas of the backlight is individually and constantly at a temporal position from the beginning of the frame period.

In the present invention, the unit time is one frame period. Accordingly, the intensity of illumination light toward the liquid crystal panel is controlled by changing the ratio of the illumination period to the non-illumination period of the backlight according to the gradation level of the image displayed in one frame period. Further, the time center of the intensity of illumination light in a divided illumination area is constant in continuous frame periods.

As a result, it is possible to realize a liquid crystal display device of high picture quality, whose entire liquid crystal panel is bright, being free from flickers perceivable by a viewer, giving a high contrast feeling, and being excellent in the performance of moving image display.

The liquid crystal display device according to the present invention is preferably arranged such that the backlight has a plurality of divided illumination areas; according to gradation levels in unit time of images displayed in divided display areas of the liquid crystal panel respectively corresponding to the divided illumination areas of the backlight, the control means controls the intensity of illumination light toward the liquid crystal panel by changing the ratio of the illumination period to the non-illumination period in the unit time of each of the divided illumination areas of the backlight individually in such a manner that the higher the gradation level, the control means increases the ratio of the illumination period to the non-illumination period in the unit time of each of the divided illumination areas of the backlight individually, and the lower the gradation level, the control means decreases the ratio of the illumination period to the non-illumination period in the unit time of each of the divided illumination areas of the backlight individually; and the control means controls the intensity of the illumination light in such a manner that in each unit time each time center of the intensity of illumination light in the divided illumination areas of the backlight is individually and constantly at a temporal position from the beginning of the frame period.

In the present invention, the backlight has a plurality of divided illumination areas. The gradation level in the unit time of the liquid crystal panel is measured per divided display area of the liquid crystal panel.

Thus, it is possible to realize images giving a high contrast feeling with enhanced contrast between bright areas and dark areas in a display screen because adjustment of contrast is carried out by each divided display area of the liquid crystal panel individually. In addition, a viewer does not perceive flickers of images because a time center of the intensity of illumination light in the unit time of a divided illumination area of the backlight is constant.

The liquid crystal display device according to the present invention is preferably arranged such that the backlight has a plurality of divided illumination areas; according to gradation levels in one frame period of images displayed in divided display areas of the liquid crystal panel respectively corresponding to the divided illumination areas of the backlight, the control means controls the intensity of illumination light toward the liquid crystal panel by changing the ratio of the illumination period to the non-illumination period in one frame period of each of the divided illumination areas of the backlight individually in such a manner that the higher the gradation level, the control means increases the ratio of the illumination period to the non-illumination period in the one frame period of each of the divided illumination areas of the backlight individually, and the lower the gradation level, the control means decreases the ratio of the illumination period to the non-illumination period in the one frame period of each of the divided illumination areas of the backlight individually; and the control means controls the intensity of the illumination light in such a manner that in each one frame period each time center of the intensity of illumination light in the divided illumination areas of the backlight is individually and constantly at a temporal position from the beginning of the frame period.

In the invention, the unit time is one frame period. As a result, it is possible to realize a liquid crystal display device of high picture quality, whose entire liquid crystal panel is bright, being free from flickers perceivable by a viewer, giving a higher contrast feeling, and being excellent in the performance of moving image display.

The liquid crystal display device according to the present invention is preferably arranged such that $t=(v+s+\tau)/2$ where v is one frame period of an image displayed in a divided display area of the liquid crystal panel corresponding to one divided illumination area of the backlight, s is a scanning period of a scan of one frame, $\tau$ is a response period of the liquid crystal panel, and t is a time from the beginning of the scan in one frame of the image displayed in the divided display area to the time center of the intensity of illumination light in each frame period of the backlight.

This arrangements makes it possible to calculate out the time t, concretely, where the time t is a time to the time center of the intensity of illumination light in each frame period.

The liquid crystal display device according to the present invention is preferably arranged such that: the backlight has the plurality of divided illumination areas in a matrix pattern; according to gradation levels in one frame period of images displayed in divided display areas of the liquid crystal panel respectively corresponding to the divided illumination areas of the backlight, the control means controls the intensity of illumination light toward the liquid crystal panel by changing the ratio of the illumination period to the non-illumination period in one frame period of each of the divided illumination areas of the backlight individually in such a manner that the higher the gradation level, the control means increases the ratio of the illumination period to the non-illumination period in the one frame period of each of the divided illumination areas of the backlight individually, and the lower the gradation level, the control means decreases the ratio of the illumination period to the non-illumination period in the one frame period of each of the divided illumination areas of the backlight individually; and the control means controls the intensity of the illumination light in such a manner that in each one frame period each time center of the intensity of illumination light in the divided illumination areas of the backlight is individually and constantly at a temporal position from the beginning of the frame period.

According to the invention, the intensity of illumination light is controlled per the divided illumination area in the matrix pattern according to the gradation level. Thus, it is possible to display finer images giving a high contrast feeling.

The liquid crystal display device according to the present invention preferably comprises frame frequency converting means for converting a frame frequency of the display image signal displayed on the liquid crystal panel into a high frequency, so that the scanning period for the scan of one frame becomes shorter than one frame period.

In the invention, means for converting frame frequency is provided. The means for converting frame frequency converts the frame frequency of the display image signal displayed on the liquid crystal panel into high frequency. Thereby, a scanning period for scanning a frame becomes shorter than one frame period.

As a result, it is possible to lengthen the illumination period in the frame period. Accordingly, it is possible to provide a liquid crystal display device whose image display is bright.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention is applicable to a liquid crystal display device provided with a liquid crystal panel, a backlight illuminating the liquid crystal panel, and control means for controlling the intensity of illumination light of the backlight.

The invention claimed is:

1. A liquid crystal display device including a liquid crystal panel, a backlight for illuminating the liquid crystal panel, and a control unit configured to control intensity of illumination light of the backlight, wherein:

according to a gradation level in unit time of an image displayed on the liquid crystal panel, the control unit is configured to control the intensity of the illumination light toward the liquid crystal panel by changing a ratio of an illumination period to a non-illumination period of the backlight in the unit time in such a manner that the higher the gradation level, the control unit increases the ratio of the illumination period to the non-illumination period of the backlight in the unit time, and the lower the gradation level, the control unit decreases the ratio of the illumination period to the non-illumination period of the backlight in the unit time; and the control unit is configured to controls the intensity of the illumination light in such a manner that in each of a plurality of consecutive units time a time center of the intensity of illumination light of the backlight is constantly at a same temporal position from the beginning of the unit time.

2. The liquid crystal display device according to claim 1, wherein:

according to a gradation level in one frame period of the image displayed on the liquid crystal panel, the control unit is configured to controls the intensity of the illumination light toward the liquid crystal panel by changing the ratio of the illumination period to the non-illumination period in one frame period in such a manner that the higher the gradation level, the control unit increases the ratio of the illumination period to the non-illumination period in the one frame period, and the lower the gradation level, the control unit decreases the ratio of the illumination period to the non-illumination period in the one frame period; and the control unit is configured to controls the intensity of the illumination light in such a manner that in each frame period a time center of the intensity of illumination light of the backlight is constantly at a temporal position from the beginning of the frame period.

3. The liquid crystal display device according to claim 1, wherein:

the backlight has a plurality of divided illumination areas;

according to the gradation level in the unit time of an image displayed on the liquid crystal panel, the control unit is configured to control the intensity of the illumination light toward the liquid crystal panel by changing the ratio of the illumination period to the non-illumination period of the backlight in the unit time in such a manner that the higher the gradation level, the control unit increases the ratio of the illumination period to the non-illumination period of the backlight in the unit time, and the lower the gradation level, the control unit decreases the ratio of the illumination period to the non-illumination period of the backlight in the unit time; and the control unit is configured to control the intensity of the illumination light in such a manner that in each unit time each time center of the intensity of illumination light in the divided illumination areas of the backlight is individually and constantly at a temporal position from the beginning of the unit time.

4. The liquid crystal display device according to claim 1, wherein:

the backlight has a plurality of divided illumination areas;

according to a gradation level in one frame period of the image displayed on the liquid crystal panel, the control unit is configured to control the intensity of the illumination light toward the liquid crystal panel by changing the ratio of the illumination period to the non-illumination period in one frame period in such a manner that the higher the gradation level, the control unit increases the ratio of the illumination period to the non-illumination period in the one frame period, and the lower the gradation level, the control unit decreases the ratio of the illumination period to the non-illumination period in the one frame period; and the control unit is configured to control the intensity of the illumination light in such a manner that in each frame period each time center of the intensity of illumination light in the divided illumination areas of the backlight is individually and constantly at a temporal position from the beginning of the frame period.

5. The liquid crystal display device according to claim 4, wherein:

$$t=(v+s+\tau)/2$$

where v is one frame period of an image displayed in a divided display area of the liquid crystal panel corresponding to one divided illumination area of the backlight, s is a scanning period of a scan of one frame, τ is a response period of the liquid crystal panel, and t is a time from the beginning of the scan in one frame of the image displayed in the divided display area to the time center of the intensity of illumination light in each frame period of the backlight.

6. The liquid crystal display device according to claim 5, comprising:

a frame frequency converting unit configured to convert a frame frequency of the display image signal displayed on the liquid crystal panel into a high frequency, so that the scanning period for the scan of one frame becomes shorter than one frame period.

7. The liquid crystal display device according to claim 1, wherein:

the backlight has a plurality of divided illumination areas;

according to gradation levels in unit time of images displayed in divided display areas of the liquid crystal panel respectively corresponding to the divided illumination areas of the backlight, the control unit is configured to control the intensity of illumination light toward the liquid crystal panel by changing the ratio of the illumination period to the non-illumination period in the unit time of each of the divided illumination areas of the backlight individually in such a manner that the higher the gradation level, the control unit increases the ratio of the illumination period to the non-illumination period in the unit time of each of the divided illumination areas of the backlight individually, and the lower the gradation level, the control unit decreases the ratio of the illumination period to the non-illumination period in the unit time of each of the divided illumination areas of the backlight individually; and the control unit is configured to control the intensity of the illumination light in such a manner that in each unit time each time center of the intensity of illumination light in the divided illumination areas of the backlight is individually and constantly at a temporal position from the beginning of the frame period.

8. The liquid crystal display device according to claim 7, wherein:

the backlight has a plurality of divided illumination areas;

according to gradation levels in one frame period of images displayed in divided display areas of the liquid crystal panel respectively corresponding to the divided illumination areas of the backlight, the control unit is configured to control the intensity of illumination light toward the liquid crystal panel by changing the ratio of the illumination period to the non-illumination period in one frame period of each of the divided illumination areas of the backlight individually in such a manner that the higher the gradation level, the control unit increases the ratio of the illumination period to the non-illumination period in the one frame period of each of the divided illumination areas of the backlight individually, and the lower the gradation level, the control unit decreases the ratio of the illumination period to the non-illumination period in the one frame period of each of the divided illumination areas of the backlight individually; and the control unit is configured to control the intensity of the illumination light in such a manner that in each one frame period each time center of the intensity of illumination light in the divided illumination areas of the backlight is individually and constantly at a temporal position from the beginning of the frame period.

9. The liquid crystal display device according to claim 8, wherein:

$$t=(v+s+\tau)/2$$

where v is one frame period of an image displayed in a divided display area of the liquid crystal panel corresponding to one divided illumination area of the backlight, s is a scanning period of a scan of one frame, τ is a response period of the liquid crystal panel, and t is a time from the beginning of the scan in one frame of the image displayed in the divided display area to the time center of the intensity of illumination light in each frame period of the backlight.

10. The liquid crystal display device according to claim 9, comprising:

a frame frequency converting unit configured to convert a frame frequency of the display image signal displayed on the liquid crystal panel into a high frequency, so that the scanning period for the scan of one frame becomes shorter than one frame period.

11. The liquid crystal display device according to claim 8, wherein:

the backlight has the plurality of divided illumination areas in a matrix pattern;

according to gradation levels in one frame period of images displayed in divided display areas of the liquid crystal panel respectively corresponding to the divided illumination areas of the backlight, the control unit is configured to control the intensity of illumination light toward the liquid crystal panel by changing the ratio of the illumination period to the non-illumination period in one frame period of each of the divided illumination areas of the backlight individually in such a manner that the higher the gradation level, the control unit increases the ratio of the illumination period to the non-illumination period in the one frame period of each of the divided illumination areas of the backlight individually, and the lower the gradation level, the control unit decreases the ratio of the illumination period to the non-illumination period in the one frame period of each of the divided illumination areas of the backlight individually; and the control unit is configured to control the intensity of the illumination light in such a manner that in each one frame period each time center of the intensity of illumination light in the divided illumination areas of the backlight is individually and constantly at a temporal position from the beginning of the frame period.

12. A liquid crystal display device including a liquid crystal panel, a backlight for illuminating the liquid crystal panel, and a control unit configured to control intensity of illumination light of the backlight, wherein:

according to a gradation level in unit time of an image displayed on the liquid crystal panel, the control unit is configured to control the intensity of the illumination light toward the liquid crystal panel by changing a ratio of an illumination period to a non-illumination period of the backlight in the unit time in such a manner that the higher the gradation level, the control unit increases the ratio of the illumination period to the non-illumination period of the backlight in the unit time, and the lower the gradation level, the control unit decreases the ratio of the illumination period to the non-illumination period of the backlight in the unit time;

the control unit is configured to control the intensity of the illumination light in such a manner that in each of a plurality of consecutive units time a time center of the intensity of illumination light of the backlight is constantly at a same temporal position from the beginning of the unit time;

according to a gradation level in one frame period of the image displayed on the liquid crystal panel, the control unit is configured to control the intensity of the illumination light toward the liquid crystal panel by changing the ratio of the illumination period to the non-illumination period in one frame period in such a manner that the higher the gradation level, the control unit increases the ratio of the illumination period to the non-illumination period in the one frame period, and the lower the gradation level, the control unit decreases the ratio of the illumination period to the non-illumination period in the one frame period;

the control unit is configured to control the intensity of the illumination light in such a manner that in each frame period a time center of the intensity of illumination light of the backlight is constantly at a temporal position from the beginning of the frame period; and $$T=(V+S+\tau)/2$$

where V is one frame period, S is a scanning period of a scan of one frame, $\tau$ is a response period of the liquid crystal panel, and T is a time from the beginning of the scan of one frame to the time center of the intensity of the illumination light in each frame period of the backlight.

13. A liquid crystal display device including a liquid crystal panel, a backlight for illuminating the liquid crystal panel, and a control unit configured to control intensity of illumination light of the backlight, wherein:

according to a gradation level in unit time of an image displayed on the liquid crystal panel, the control unit is configured to control the intensity of the illumination light toward the liquid crystal panel by changing a ratio of an illumination period to a non-illumination period of the backlight in the unit time in such a manner that the higher the gradation level, the control unit increases the ratio of the illumination period to the non-illumination period of the backlight in the unit time, and the lower the gradation level, the control unit decreases the ratio of the illumination period to the non-illumination period of the backlight in the unit time;

the control unit is configured to control the intensity of the illumination light in such a manner that in each of a plurality of consecutive units time a time center of the intensity of illumination light of the backlight is constantly at a same temporal position from the beginning of the unit time;

according to a gradation level in one frame period of the image displayed on the liquid crystal panel, the control unit is configured to control the intensity of the illumination light toward the liquid crystal panel by changing the ratio of the illumination period to the non-illumination period in one frame period in such a manner that the higher the gradation level, the control unit increases the ratio of the illumination period to the non-illumination period in the one frame period, and the lower the gradation level, the control unit decreases the ratio of the illumination period to the non-illumination period in the one frame period;

the control unit is configured to control the intensity of the illumination light in such a manner that in each frame period a time center of the intensity of illumination light of the backlight is constantly at a temporal position from the beginning of the frame period;

$$T=(V+S+\tau)/2$$

where V is one frame period, S is a scanning period of a scan of one frame, $\tau$ is a response period of the liquid crystal panel, and T is a time from the beginning of the scan of one frame to the time center of the intensity of the illumination light in each frame period of the backlight; and wherein the liquid crystal display device further includes a frame frequency converting unit configured to convert a frame frequency of the display image signal displayed on the liquid crystal panel into a high frequency, so that the scanning period for the scan of one frame becomes shorter than one frame period.

* * * * *